United States Patent [19]

Versaw et al.

[11] Patent Number: 4,591,822

[45] Date of Patent: May 27, 1986

[54] BIMETAL THERMOSTAT WITH HEAD COLLECTOR

[75] Inventors: Douglas P. Versaw, Mansfield, Ohio; Theo de Geest, Eindhoven, Netherlands

[73] Assignee: Therm-O-Disc, Incorporated, Mansfield, Ohio

[21] Appl. No.: 677,026

[22] Filed: Nov. 30, 1984

[51] Int. Cl.[4] ..... H01H 37/04; H01H 37/52

[52] U.S. Cl. ..... 337/380; 337/327; 337/354; 165/185

[58] Field of Search ..... 337/380, 354, 327; 236/DIG. 19, DIG. 14; 165/80.1, 80.3, 185

[56] References Cited

U.S. PATENT DOCUMENTS 3,297,845 1/1967 Mertler ..... 337/380

3,317,693 5/1967 Bolesky .

*Primary Examiner*—Harold Broome

*Attorney, Agent, or Firm*—Pearne, Gordon, Sessions, McCoy, Granger & Tilberry

[57] ABSTRACT

A detector thermostat for fire detection systems is disclosed. Such detector thermostat includes a bimetal snap disc thermostat having a metallic disc cup which supports the snap disc. A heat collector is mounted on the disc cup in good heat transfer relationship therewith. The collector provides a flange formed with concentric circular convolutions and a circular array of projections cut from the material of the flange and extending substantially perpendicular to the flange. The projections are positioned around the disc cup and provide improved sensitivity to the flow of hot air and gases in a direction parallel to the plane of the flange.

11 Claims, 4 Drawing Figures

BIMETAL THERMOSTAT WITH HEAD COLLECTOR

BACKGROUND OF THE INVENTION

This invention relates generally to bimetal operated thermostats, and more particularly to a novel and improved heat collector thermostat combination particularly suited for use in fire detection or alarm systems.

PRIOR ART

Bimetal snap disc thermostats are often employed as the detector in a fire alarm system. Such thermostats are often provided with a heat collector which is mounted on the disc cup of a thermostat to increase the sensitivity of the thermostat. Generally, such heat collectors are circular and provide generally planar flanges which extend radially from the disc cup. Some such collectors have been provided with flanges formed with concentric circular convolutions to increase the stiffness and others provide radial convolutions, again to improve stiffness.

Generally, such thermostats have been mounted in patterns or arrays along the surface of a ceiling so that a fire located substantially anywhere within the room will cause one or more of the thermostats to operate and trigger the alarm system. The permissible spacing between the thermostats within the pattern or array is determined by the sensitivity of the thermostat to a fire condition.

Such prior art thermostats function well in detecting fires which are located below the thermostat or in relatively close proximity to the side thereof. However, such thermostats tend to be relatively insensitive in detecting fires laterally spaced a substantial distance to one side of the thermostat. Therefore, these devices have required relatively close spacing within the pattern in order to provide the required sensitivity in the system.

SUMMARY OF THE INVENTION

In accordance with the present invention, a novel and improved heat collector thermostat combination is provided which results in increased sensitivity to fire conditions, particularly when such fire conditions are located laterally spaced a substantial distance to the side of the thermostat. The heat collector is provided with improved sensitivity without requiring additional material in its manufacture, and without any significant increase in the manufacturing cost.

Because the combination provides improved sensitivity to fire conditions, the spacing between the thermostats can be significantly increased, with the result that a given installation requires a substantially fewer number of thermostats while still providing good fire detection properties.

The illustrated collector differs from the prior art in that it is provided with a circular array of lateral projections extending around the disc cup adjacent to the periphery thereof. These projections are produced by forming U-shaped lances in the collector material to provide the projections, which are bent out of the plane of the collector flange and extend substantially perpendicular thereto.

The projections, because they extend out of the plane of the collector flange, are impinged upon by fire-heated air and gases flowing in a direction substantially parallel to the plane of the collector flange, and therefore cause the thermostat to respond better to such flow conditions.

Since the projections cause the thermostat to respond better to fires which are spaced a substantial distance to one side of the thermostat, a given area can be properly protected by substantially fewer thermostats. This reduces the cost of the alarm system incorporating this invention in several ways: first, the number of thermostats required in a given system is reduced; second, the amount of wire required to connect the thermostats is reduced; and, third, the installation labor costs are reduced because fewer thermostats must be installed and connected.

These and other aspects of the present invention are illustrated in the accompanying drawings, and are more fully described in the following specification.

DETAILED DESCRIPTION OF THE DRAWINGS

Figure 1:
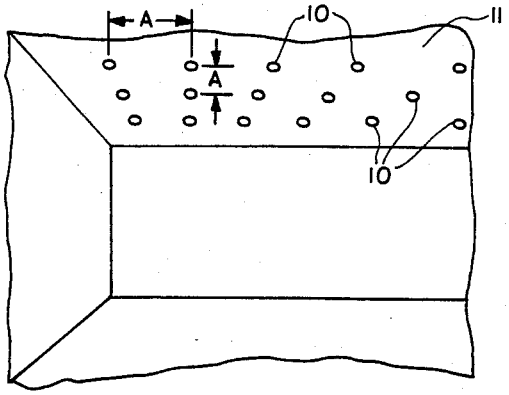
FIG. 1 is a fragmentary, perspective view, illustrating a portion of a ceiling provided with an array of thermostats in accordance with the present invention.

FIG. 1 schematically illustrates the manner in which thermostats or detectors in accordance with the present invention may be installed in a room as part of a fire detection or alarm system. In such installation, the thermostats 10 in accordance with this invention are mounted in a ceiling 11 of the room to be protected. Such thermostats are normally installed in an array which may for example, as illustrated, provide the thermostats 10 in a square pattern in which the distance A between adjacent thermostats 10 is twenty feet. It should be understood that in FIG. 1, the scale of the drawing is not accurate, that the illustrated thermostats have circular collectors about 1½ inches in diameter, and that the spacing A will be at least a number of feet. FIG. 1, however, is intended to substantially illustrate how an array of thermostats 10 may be installed in a ceiling of a room.

Figure 4:
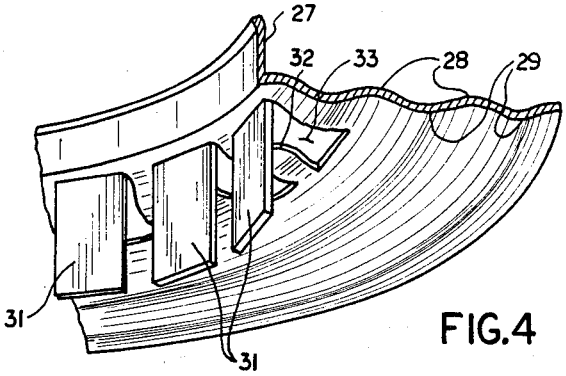
FIG. 4 is a fragmentary, perspective view of the collector shield illustrating the arrangement of the projections and the structure of the flange.
Figure 2:
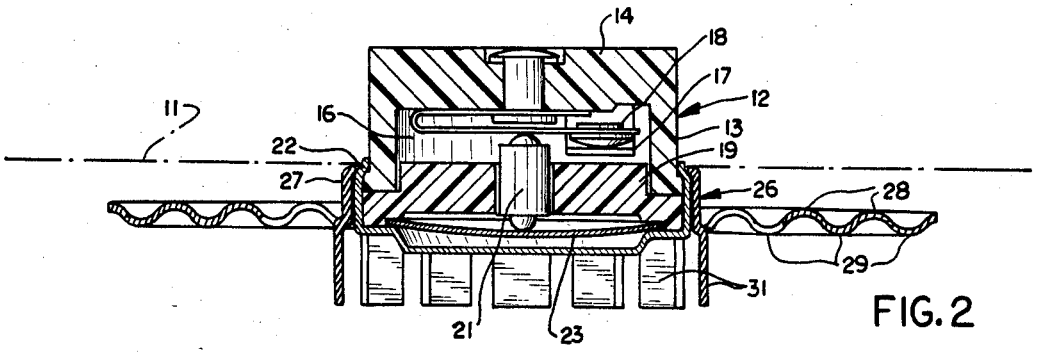
FIG. 2 is a side elevation in vertical section, illustrating the structure of one preferred thermostat and collector shield combination.
Figure 3:
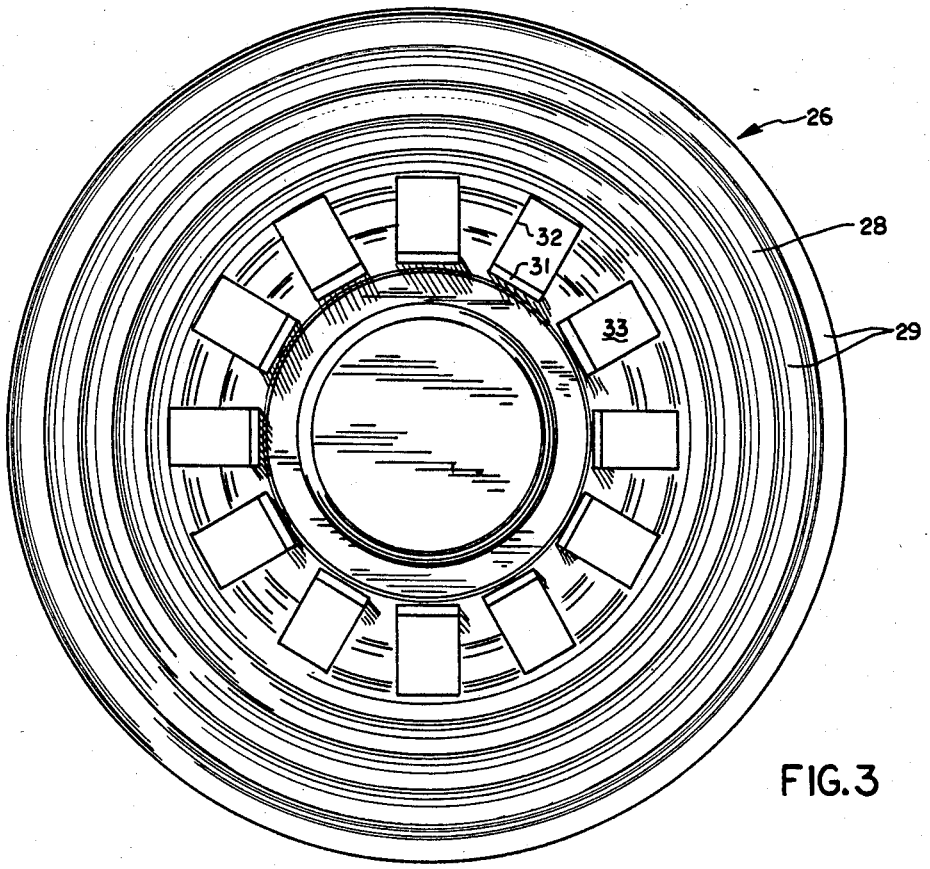
FIG. 3 is a bottom plan view of the combination illustrated in FIG. 2.

Referring to FIGS. 2 through 4, the thermostat includes a body 12 which is generally circular in section, providing a cylindrical sidewall 13 and an end wall 14 so that the body defines a portion of a switch chamber 16. Mounted on the body 12 within the switch chamber 16 is a fixed contact 17 and a movable contact 18. A bumper guide member 19 closes the switch chamber 16 and provides a central opening in which a bumper 21 is positioned. A disc cup 22 is mounted on the body 12 and connects the bumper guide member 19 to the body. Further, the disc cup provides the support for a bimetal snap disc 23.

The snap disc is provided with a shallow curvature so that it snaps back and forth between two positions of stability upon reaching predetermined calibration temperatures. When the disc 23 is in the downwardly curved position illustrated in FIG. 2, the switch contacts are closed, and when the disc snaps through to its upwardly curved position of stability, it operates through the bumper 21 to open the switch. The thermostat itself is more fully disclosed and described in U.S. Pat. No. 3,317,693, and such patent is incorporated herein by reference for such more detailed description of the thermostat structure and for its mode of operation.

The disc cup is metallic, and preferably formed of aluminum which has a high coefficient of heat transfer so that heat applied to the disc cup will be efficiently and quickly transmitted therethrough to the bimetal snap disc and so that the disc can react quickly when the thermostat is subjected to the heat of a fire or the like.

In order to increase the sensitivity of the device, a heat collector 26 is mounted on the disc cup. Such heat collector is again preferably formed of aluminum or other highly conductive metal and provides a cylindrical wall portion 27 which closely fits the sidewall of the disc cup in good heat transfer relationship therewith. The heat collector also provides a flange portion 28 which extends generally radially from the disc cup. Such flange portion, in the illustrated embodiment, is provided with a plurality of concentric circular convolutions 29 to improve the stiffness of the flange.

At the inner extremity of the flange 28, and substantially adjacent to the periphery of the disc cup 22, the material of the collector is bent down to provide a plurality of rectangular projections 31. Such projections are formed by making a U-shaped cut or lance 32 and bending the projections 31 down so that they extend substantially perpendicular to the flange 28 in a circular array around the periphery of the disc cup. An opening 33 is therefore provided adjacent each of the tabs or projections 31 resulting from the removal of the material of the projection 31 from the flange 28.

The assignee of the present invention has marketed thermostats with collectors mounted thereon which are identical to the illustrated collectors and thermostats except for the fact that such collectors have not provided the tabs or projections 31, nor have the collectors provided the openings 33. Such prior manufacture by the assignee of the present invention constitutes prior art with respect to this invention.

The provision of the tabs improves the sensitivity of the thermostat collector combination to a fire condition at a location to one side of the thermostat. If, for example, a particular thermostat 10 or detector is located in the ceiling immediately above a fire, the heat rising from the fire is efficiently transmitted to the collector. Therefore, the thermostat quickly reaches its operating temperature, causing the switch to operate. This provides a signal that a fire is present.

In the event, however, that the fire is not directly under the thermostat, the heat from the fire tends to rise to the ceiling but does not directly encounter the collector or thermostat at such point. The hot air or gases from the fire, however, spread along the surface of the ceiling and ultimately reach a location where a detector thermostat is mounted. The flow of the hot gases or air at such point is essentially parallel to the plane of the ceiling and, since the detectors are mounted in the ceiling 11 with the collector flanges parallel to the ceiling, such flow does not produce a good heat transfer to the collector flanges. Such horizontal flow parallel to the ceiling, however, impinges upon the depending projections 31 and results in an efficient heat transfer to the collector, and in turn to the bimetal snap disc. Further, such horizontal flow also impinges on the edges of the openings 33 and this further improves the sensitivity of the device. Consequently, with these projections and adjacent openings, the sensitivity of the thermostat to hot gases flowing in a direction parallel to the ceiling and parallel to the plane of the collector is significantly improved.

Because of these projections, the thermostat is qualified for use in systems wherein the spacing A is increased substantially. Consequently, systems incorporating thermostats in accordance with this invention require fewer thermostats in a given installation and less wiring is also required because fewer thermostats are used. Consequently, the material costs of the system are reduced. Further, the installation labor costs are reduced because fewer thermostats must be installed and fewer connections need be made.

Although the preferred embodiment of this invention has been shown and described, it should be understood that various modifications and rearrangements of the parts may be resorted to without departing from the scope of the invention as disclosed and claimed herein.

What is claimed is:

1. A bimetal snap disc thermostat comprising a circular body, a switch mounted in said body, a circular metallic disc cup mounted on said body, a bimetal snap disc supported at least in part by said disc cup connected to operate said switch upon reaching a predetermined temperature, and a metallic heat collector mounted on the exterior of said disc cup providing a generally planar flange extending therefrom, said heat collector also providing a circular array of projections cut from the material of said flange and extending substantially perpendicular to said flange, said projections substantially increasing the sensitivity of said thermostat to fluid flow in a direction substantially parallel to said flange.

2. A bimetal snap disc thermostat as set forth in claim 1, wherein said flange is circular and is formed with concentric circular convolutions.

3. A bimetal snap disc thermostat as set forth in claim 2, wherein there is an opening through said flange adjacent to each projection on the side thereof opposite said cup.

4. A bimetal snap disc thermostat as set forth in claim 1, wherein there is an opening through said flange adjacent to each projection on the side thereof opposite said cup.

5. A bimetal snap disc thermostat as set forth in claim 4, wherein said projections are formed by a generally U-shaped lance through said flange and said projections are bent to a position substantially perpendicular to said flange.

6. A detector for fire detection systems comprising a switch body, a switch mounted in said body, a metallic cover assembly mounted on said body, bimetal means supported at least in part by said cover assembly and operating said switch upon reaching a predetermined temperature, said cover assembly including a generally planar flange portion extending outwardly from said bimetal and a plurality of spaced projections extending substantially perpendicular to said flange, said projections increasing the sensitivity of said detector to the flow of hot gases substantially parallel to said flange to increase the area within which said detector is operable to detect a fire.

7. A detector as set forth in claim 6, wherein a plurality of said detectors are installed in an array, and said areas of said detectors overlap to provide full coverage of said array.

8. A detector as set forth in claim 6, wherein said projections are arranged in a pattern adjacent to the periphery of said bimetal means.

9. A detector as set forth in claim 8, wherein said bimetal means is a snap disc and said cover assembly supports the periphery of said snap disc.

10. A detector as set forth in claim 9, wherein there is an opening through said flange adjacent to each projection and on the side thereof opposite said cup.

11. A detector as set forth in claim 10, wherein said projections are formed by a generally U-shaped lance through said flange and are bent to a position substantially perpendicular to said flange.

* * * * *